US007474270B2

(12) United States Patent
Wu et al.

(10) Patent No.: US 7,474,270 B2
(45) Date of Patent: Jan. 6, 2009

(54) ELECTRONIC DEVICE WITH AN INTERNAL ANTENNA

(75) Inventors: Chien-Yi Wu, Tao Yuan Shien (TW); Cheng-Hsiung Wu, Tao Yuan Shien (TW); Chi-Yin Fang, Tao Yuan Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 126 days.

(21) Appl. No.: 11/725,356

(22) Filed: Mar. 19, 2007

(65) Prior Publication Data

US 2008/0048926 A1 Feb. 28, 2008

(30) Foreign Application Priority Data

Aug. 23, 2006 (TW) ..... 95214934 U

(51) Int. Cl.
*H01Q 1/24* (2006.01)

(52) U.S. Cl. ..... 343/702; 343/700 MS

(58) Field of Classification Search ..... 343/700 MS, 343/702
See application file for complete search history.

(56) References Cited

U.S. PATENT DOCUMENTS

| | | | | |
|---|---|---|---|---|
| 6,963,310 | B2 * | 11/2005 | Horita et al. | 343/702 |
| 7,199,757 | B2 * | 4/2007 | Tung | 343/700 MS |
| 7,289,072 | B2 * | 10/2007 | Sakurai | 343/702 |
| 7,304,616 | B1 * | 12/2007 | Chen et al. | 343/846 |
| 7,403,164 | B2 * | 7/2008 | Sanz et al. | 343/702 |

* cited by examiner

*Primary Examiner*—Tan Ho
(74) *Attorney, Agent, or Firm*—The Webb Law Firm

(57) ABSTRACT

An electronic device includes a casing, a circuit board, and an internal antenna unit. The circuit board is disposed in the casing. The internal antenna unit is disposed in the casing, and includes a feeding element that overlaps with the circuit board, and first and second radiating elements, each of which extends from the feeding element toward a wall of the casing beyond an edge of the circuit board. A feeding point is provided on the feeding element, and is coupled to the edge of the circuit board. A grounding point is provided on the feeding element, and is coupled to the edge of the circuit board.

19 Claims, 5 Drawing Sheets

ELECTRONIC DEVICE WITH AN INTERNAL ANTENNA

CROSS-REFERENCE TO RELATED APPLICATION

This application claims priority of Taiwanese application no. 095214934, filed on Aug. 23, 2006.

BACKGROUND OF THE INVENTION

1. Field of the Invention

This invention relates to an electronic device, more particularly to an electronic device that includes an internal antenna.

2. Description of the Related Art

FIG. 1 illustrates a conventional electronic device, such as a mobile phone, that includes a casing 11, a circuit board 12, and an internal antenna 13. The circuit board 12 is disposed in the casing 11. The internal antenna 13, which is a planar inverted-Fantenna (PIFA), is disposed in the casing 11, is operable in both 900 MHz and 1800 MHz frequency bandwidths, is generally rectangular in shape, and is formed with a first groove 131 that extends between opposite first and second edges of the internal antenna 13, and a second groove 132 that extends transversely from the first groove 131 to a third edge of the internal antenna 13. A feeding point 133 is provided on the internal antenna 13, and is coupled to the circuit board 12 through a feeding line. A grounding point 134 is provided on the internal antenna 13, and is coupled to an electrical ground provided on the circuit board 12 through a grounding line.

The conventional electronic device is disadvantageous in that, since a relatively large portion of the internal antenna 13 overlaps with the circuit board 12, a considerable capacitance effect, which causes undesirable interference to the transmitted and received signals of the internal antenna 13, is produced. This results in a poor signal quality for the conventional electronic device.

SUMMARY OF THE INVENTION

Therefore, the object of the present invention is to provide an electronic device that can overcome the aforesaid drawback of the prior art.

According to the present invention, an electronic device comprises a casing, a circuit board, and an internal antenna unit. The casing includes a wall. The circuit board is disposed in the casing, is spaced apart from the wall of the casing, and has first and second edges that are respectively proximate to and distal from the wall of the casing. The internal antenna unit is disposed in the casing, and includes first and second antennas, a feeding point, and a grounding point. The first antenna is operable within a first frequency bandwidth, and includes a feeding element that overlaps with the circuit board, and a first radiating element that extends from the feeding element toward the wall of the casing beyond the first edge of the circuit board. The feeding point is provided on the feeding element, and is coupled to the first edge of the circuit board. The second antenna is operable within a second frequency bandwidth, extends from the feeding element, and includes a second radiating element that extends toward the wall of the casing beyond the first edge of the circuit board.

The grounding point is provided on the feeding element, and is coupled to the first edge of the circuit board.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
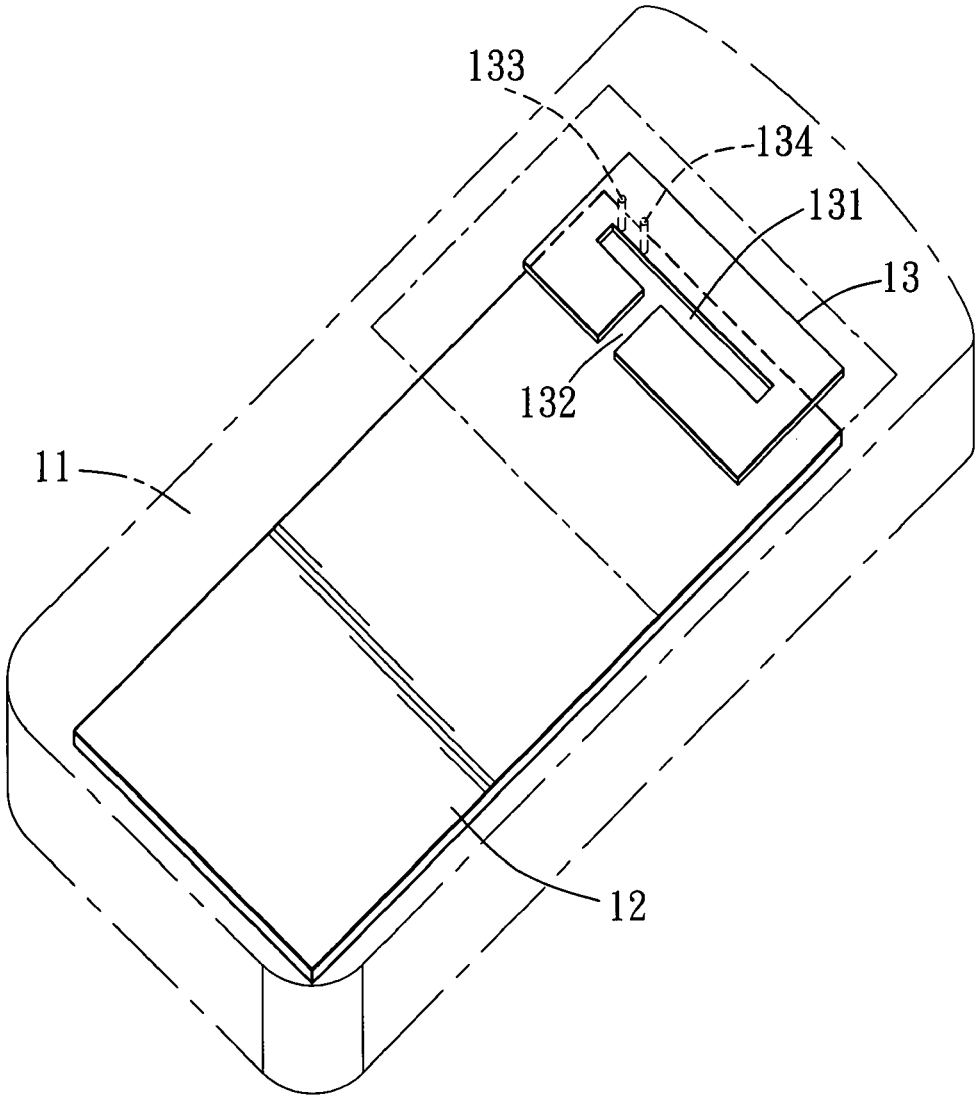
FIG. 1 PRIOR ART
FIG. 1 is a perspective view of a conventional electronic device.

Before the present invention is described in greater detail, it should be noted that like elements are denoted by the same reference numerals throughout the disclosure.

Figure 2:
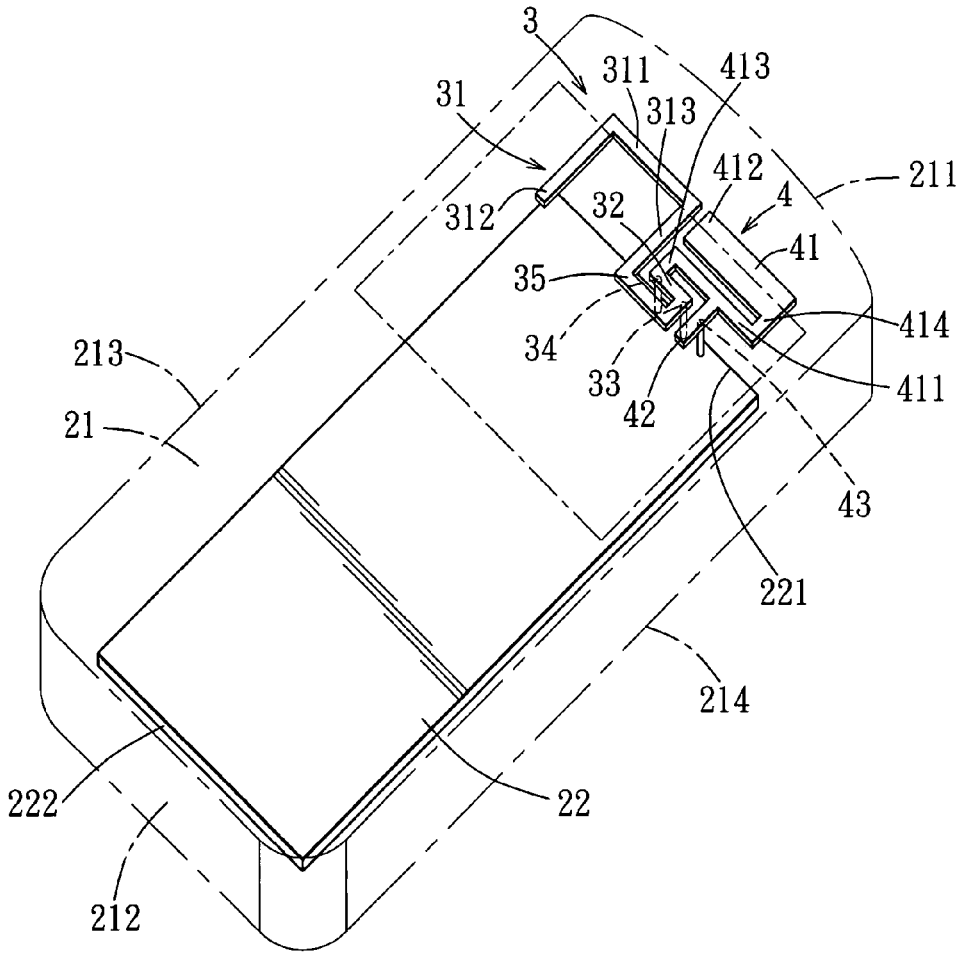
FIG. 2 is a perspective view of the first preferred embodiment of an electronic device according to the present invention.
Figure 3:
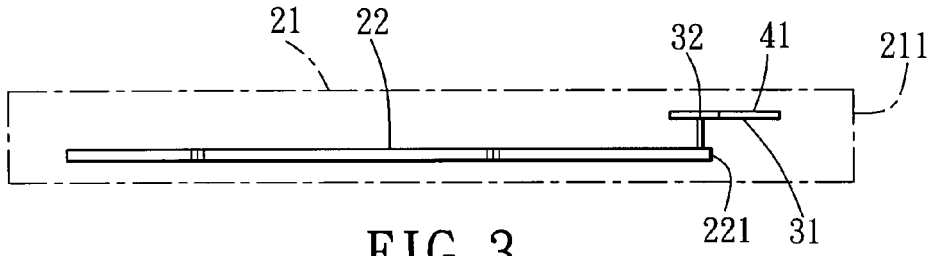
FIG. 3 is a schematic side view of FIG. 2.

Referring to FIGS. 2 and 3, the first preferred embodiment of an electronic device according to this invention includes a casing 21, a circuit board 22, and an internal antenna unit.

The electronic device in this embodiment is a mobile phone. In an alternative embodiment, the electronic device may be one of a personal digital assistant (PDA) and a notebook computer.

The casing 21 is generally rectangular in shape, and includes first and second walls 211, 212 that are opposite to each other in a first direction, and third and fourth walls 213, 214 that are opposite to each other in a second direction transverse to the first direction.

The circuit board 22 is generally rectangular in shape, is disposed in the casing 21, is spaced apart from the first wall 211 of the casing 21, and has opposite first and second edges 221, 222 that are respectively proximate to and distal from the first wall 211 of the casing 21.

The internal antenna unit is disposed in the casing 21, and includes first and second antennas 3, 4, first and second feeding points 33, 43, and a grounding point 34.

The first antenna 3 is a planar inverted-F antenna (PIFA), is operable within a 900 MHz frequency bandwidth, and has an effective antenna length of one-quarter of a wavelength. In this embodiment, the first antenna 3 includes a first feeding element 32, and a first radiating element 31 that extends from the first feeding element 32 toward the first wall 211 of the casing 21 beyond the first edge 221 of the circuit board 22. In particular, the first radiating element 31 has first, second, and third segments 312, 313, 311. Each of the first and second segments 312, 313 of the first radiating element 31 extends in the first direction, and has first and second ends that are respectively proximate to and distal from the first wall 211 of the casing 21. The third segment 311 of the first radiating element 31 extends in the second direction, and interconnects the first ends of the first and second segments 312, 313 of the first radiating element 31. The second segment 313 of the first radiating element 31 is disposed between the first feeding element 32 and the first segment 312 of the first radiating element 31. The first feeding element 32 extends in the second direction, overlaps with the circuit board 22, and has first and second ends that are respectively proximate to and distal from the second segment 313 of the first radiating element 31. The first radiating element 31 further includes a fourth segment 35 that is generally L-shaped, that overlaps with the circuit board 22, and that interconnects the second ends of the second segment 313 of the first radiating element 31 and the first feeding element 32.

The first feeding point 33 is provided on the first feeding element 32 at a junction of the fourth segment 35 of the first radiating element 31 and the second end of the first feeding element 32, and is coupled to the first edge 221 of the circuit board 22 through a first feeding line.

The second antenna 4, like the first antenna 3, is a PIFA, is operable within a 1800 MHz frequency bandwidth, and has an effective antenna length of one-quarter of a wavelength. In this embodiment, the second antenna 4 includes a second radiating element 41 that extends from the first feeding element 32 toward the first wall 211 of the casing 21 beyond the first edge 221 of the circuit board 22. In particular, the second segment 313 of the first radiating element 31 is disposed between the second radiating element 41 and the first segment 312 of the first radiating element 31. The second radiating element 41 has first and second segments 411, 412. Each of the first and second segments 411, 412 of the second radiating element 41 extends in the second direction, and has first and second ends that are respectively proximate to and distal from the second segment 313 of the first radiating element 31. The first segment 411 of the second radiating element 41 is disposed between the first feeding element 32 and the second segment 412 of the second radiating element 41. The second radiating element 41 further includes a third segment 413 that extends in the first direction, and that interconnects the first ends of the first feeding element 32 and the first segment 411 of the second radiating element 41, and a fourth segment 414 that extends in the first direction, and that interconnects the second ends of the first and second segments 411, 412 of the second radiating element 41.

It is noted herein that, in an alternative embodiment, the second antenna 4 is further operable in a 1900 MHz frequency bandwidth.

The grounding point 34 is provided on the first feeding element 32 at a junction of the first end of the first feeding element 32 and the third segment 413 of the second radiating element 41, and is coupled to an electrical ground (not shown) provided on the first edge 221 of the circuit board 22 through a grounding line.

The internal antenna unit further includes a second feeding element 42. The first feeding element 32 is disposed between the second feeding element 42 and the second segment 313 of the first radiating element 31. The second feeding element 42 extends in the first direction from the second radiating element 41, and has first and second ends that are respectively proximate to and distal from the first wall 211 of the casing 21. The first end of the second feeding element 42 is connected to the first segment 411 of the second radiating element 41 at a position between the first and second ends of the first segment 411 of the second radiating element 41.

The second feeding point 43 is provided on the second end of the second feeding element 42, and is coupled to the first edge 221 of the circuit board 22 through a second feeding line. As such, the first feeding point 33 is disposed between the second feeding point 43 and the grounding point 34.

In this embodiment, the first and second feeding points 33, 43 are aligned with each other along the first feeding element 32, and the grounding point 34 is aligned with the first and second feeding points 33, 43. That is, the first and second feeding points 33, 43, and the grounding point 34 are aligned along the second direction.

From the above description, since only the second ends of the first and second segments 312, 313 of the first radiating element 31, the first feeding element 32, the fourth segment 35 of the first radiating element 31, and the second end of the second feeding element 42 overlap with the circuit board 22, capacitance effect due to overlapping of the internal antenna unit with the circuit board 22 is minimized, thereby enhancing signal quality of the electronic device of this invention.

Figure 4:
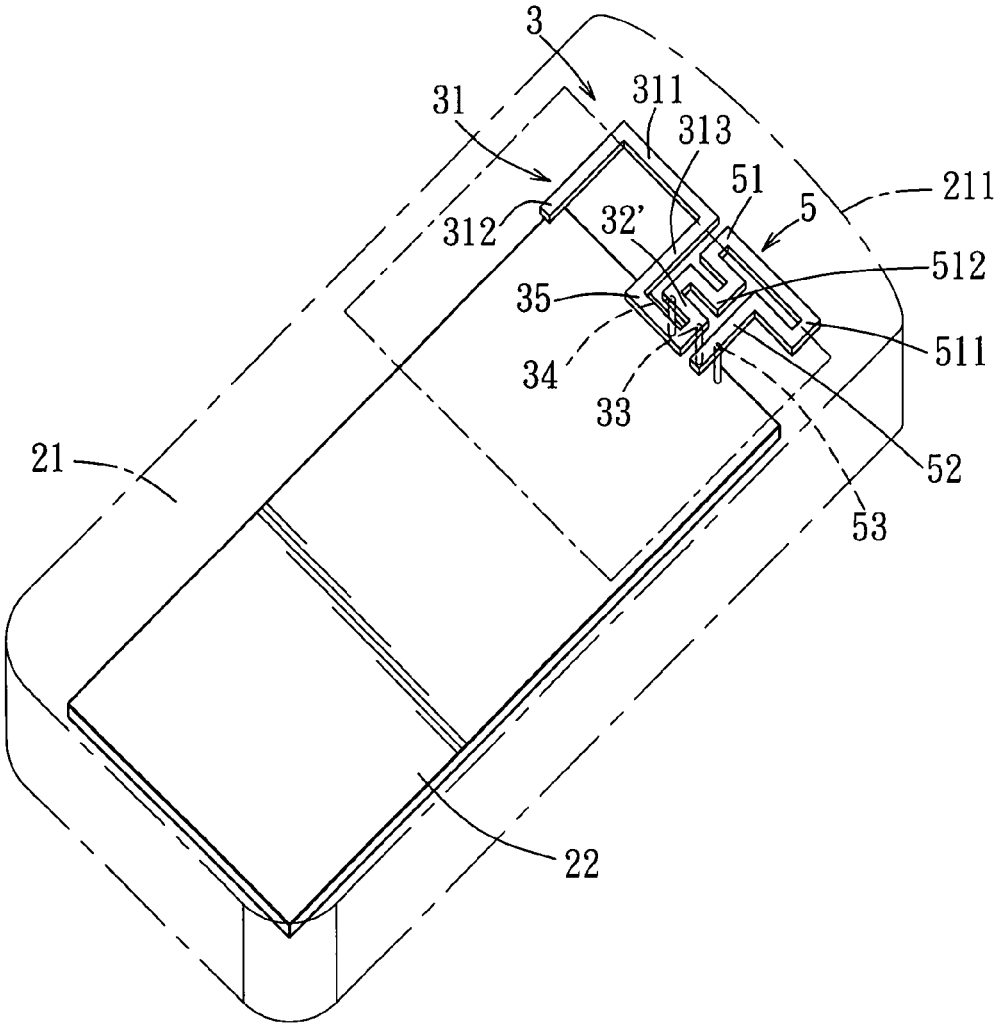
FIG. 4 is a perspective view of the second preferred embodiment of an electronic device according to the present invention.

FIG. 4 illustrates the second preferred embodiment of an electronic device according to this invention. When compared to the previous embodiment, the second antenna 5 is a loop antenna and has an effective antenna length of one-half of a wavelength.

The second radiating element 51 has a first segment 511 and a second segment 512. The first segment 511 of the second radiating element 51 has first and second ends. The second segment 512 of the second radiating element 51 interconnects the first ends of the first segment 511 of the second radiating element 51 and the first feeding element 32.

The first end of the second feeding element 52 is connected to the second end of the first segment 511 of the second radiating element 51.

The second feeding point 53 is provided on the second end of the second feeding element 52, and is coupled to the first edge 221 of the circuit board 22 through the second feeding line.

Figure 5:
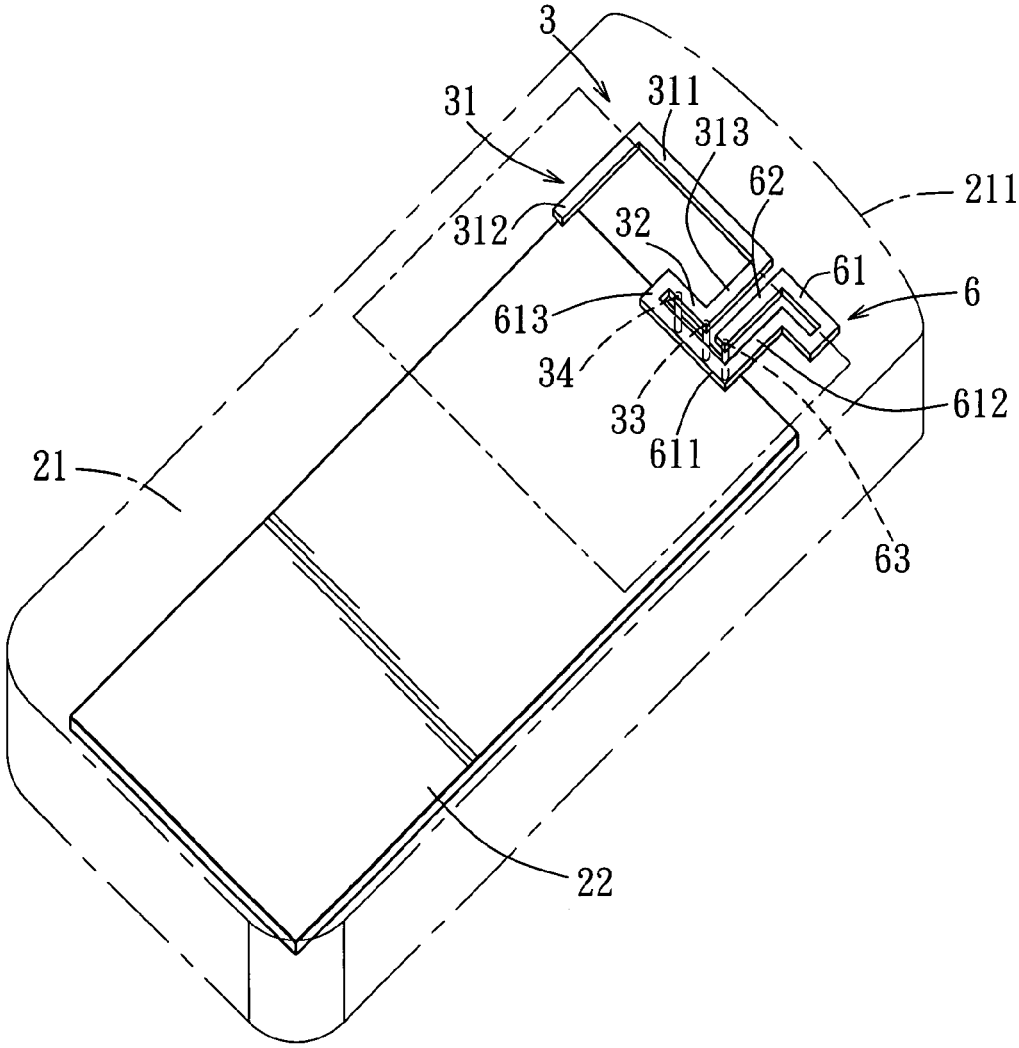
FIG. 5 is a perspective view of the third preferred embodiment of an electronic device according to the present invention.

FIG. 5 illustrates the third preferred embodiment of an electronic device according to this invention. When compared to the first embodiment, the second antenna 6 is a loop antenna and has an effective antenna length of one-half of a wavelength.

The first feeding element 32 is disposed between the first and second segments 312, 313 of the first radiating element 31. The first and second ends of the first feeding element 32 are respectively proximate to and distal from the first segment 312 of the first radiating element 31. The second end of the first feeding element 32 is connected to the second end of the second segment 313 of the first radiating element 31.

The second radiating element 61 has first, second and third segments 611, 612, 613. The first segment 611 of the second radiating element 61 extends in the second direction, overlaps with the circuit board 22, and has first and second ends that are respectively proximate to and distal from the first segment 312 of the first radiating element 31. The third segment 613 extends in the first direction, and interconnects the first end of the first segment 611 of the second radiating element 61 and the first end of the first feeding element 32. The second segment 313 of the first radiating element 31 is disposed between the first segment 312 of the first radiating element 31 and the second segment 612 of the second radiating element 61.

The second feeding element 62 extends in the first direction, is disposed between the second segment 313 of the first radiating element 31 and the second segment 612 of the second radiating element 61, and has first and second ends that are respectively proximate to and distal from the first wall 211 of the casing 21.

The second segment 612 of the second radiating element 61 interconnects the second end of the first segment 611 of the second radiating element 61 and the first end of the second feeding element 62.

The second feeding point 63 is provided on the second end of the second feeding element 62, and is coupled to the first edge 221 of the circuit board 22 through the second feeding line.

Figure 6:
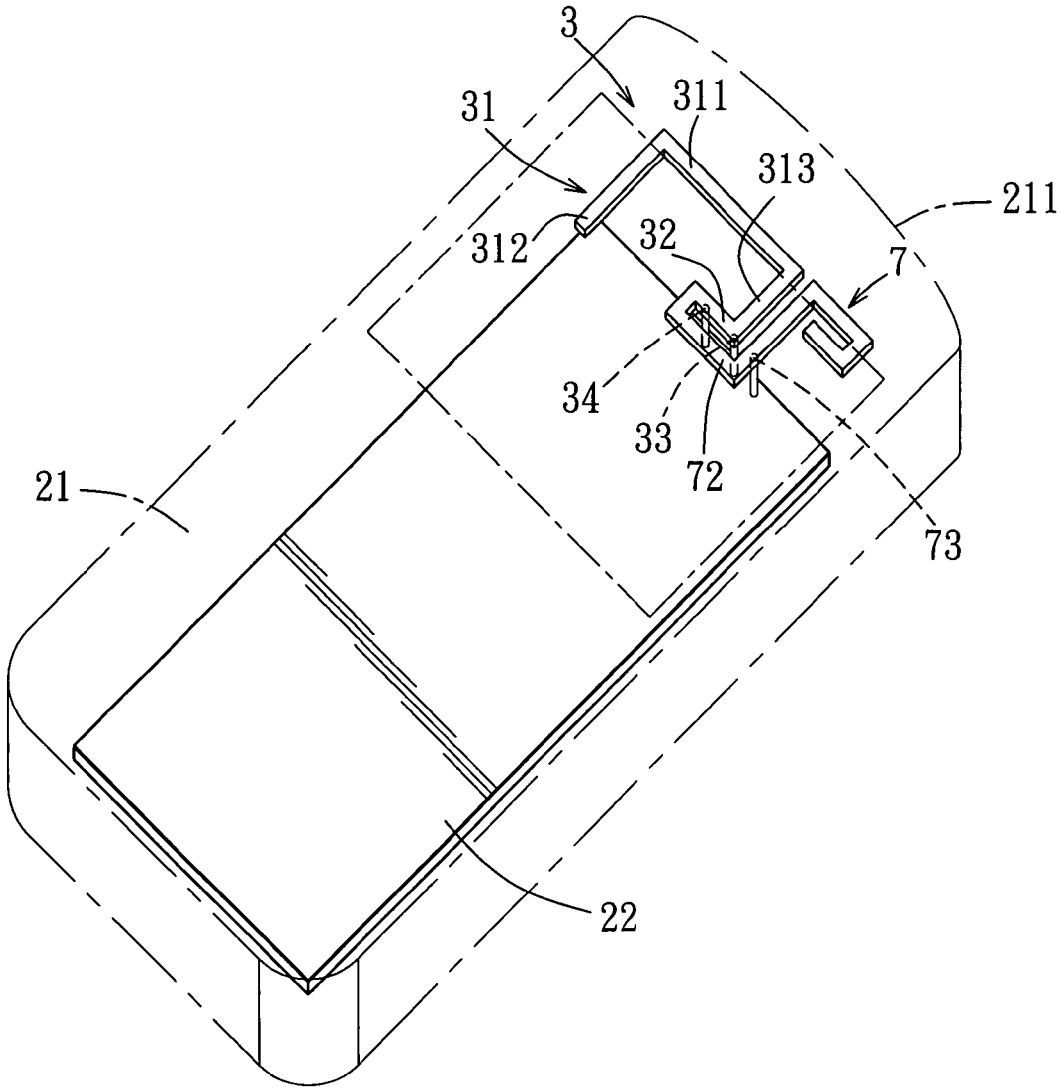
FIG. 6 is a perspective view of the fourth preferred embodiment of an electronic device according to the present invention.

FIG. 6 illustrates the fourth preferred embodiment of an electronic device according to this invention. When compared with the third embodiment, the second segment 313 of the first radiating element 31 is disposed between the second radiating element 7 and the first segment 312 of the first radiating element 31.

The second feeding element 72 overlaps with the circuit board 22, and interconnects the first end of the first feeding element 32 and the second radiating element 7.

The second feeding point 73 is provided on the second feeding element 72 at a junction of the second feeding element 72 and the second radiating element 7, and is coupled to the first edge 221 of the circuit board 22 through the second feeding line.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electronic device, comprising:

a casing including a wall;

a circuit board disposed in said casing, spaced apart from said wall of said casing, and having first and second edges that are respectively proximate to and distal from said wall of said casing; and an internal antenna unit disposed in said casing, and including a first antenna that is operable within a first frequency bandwidth, said first antenna including a first feeding element that overlaps with said circuit board, and a first radiating element that extends from said first feeding element toward said wall of said casing beyond said first edge of said circuit board, a first feeding point that is provided on said first feeding element and that is coupled to said first edge of said circuit board, a second antenna that is operable within a second frequency bandwidth and that extends from said first feeding element, said second antenna including a second radiating element that extends toward said wall of said casing beyond said first edge of said circuit board, and a grounding point that is provided on said first feeding element, and that is coupled to said first edge of said circuit board.

2. The electronic device as claimed in claim 1, wherein said second radiating element of said second antenna extends from said first feeding element, said internal antenna unit further including a second feeding element that extends from said second radiating element, and a second feeding point that is provided on said second feeding element and that is coupled to said first edge of said circuit board.

3. The electronic device as claimed in claim 2, wherein said first feeding point is disposed between said second feeding point and said grounding point.

4. The electronic device as claimed in claim 2, wherein said first feeding point and said grounding point are aligned with each other along said first feeding element, said second feeding point being aligned with said first feeding point and said grounding point.

5. The electronic device as claimed in claim 2, wherein said grounding point is provided at a junction of said first feeding element and said second radiating element.

6. The electronic device as claimed in claim 2, wherein said first radiating element has first and second segments, each of which has first and second ends that are respectively proximate to and distal from said wall of said casing, and a third segment that interconnects said first ends of said first and second segments of said first radiating element, said second segment of said first radiating element being disposed between said second radiating element and said first segment of said first radiating element.

7. The electronic device as claimed in claim 6, wherein said second segment of said first radiating element is disposed between said first feeding element and said first segment of said first radiating element, said first feeding element having first and second ends that are respectively proximate to and distal from said second segment of said first radiating element, said second end of said first feeding element being coupled to said second end of said second segment of said first radiating element.

8. The electronic device as claimed in claim 7, wherein said second radiating element has first and second segments, each of which has first and second ends that are respectively proximate to and distal from said second segment of said first radiating element, said first segment of said second radiating element being disposed between said first feeding element and said second segment of said second radiating element, said first end of said first segment of said second radiating element being coupled to said first end of said first feeding element, said second end of said second segment of said second radiating element being coupled to said second end of said first segment of said second radiating element.

9. The electronic device as claimed in claim 8, wherein said first feeding element is disposed between said second feeding element and said second segment of said first radiating element, said second feeding element having first and second ends that are respectively proximate to and distal from said wall of said casing, said first end of said second feeding element being connected to said first segment of said second radiating element at a position between said first and second ends of said first segment of said second radiating element, said second feeding point being provided on said second end of said second feeding element.

10. The electronic device as claimed in claim 7, wherein said first radiating element further includes a fourth segment that overlaps with said circuit board, and that interconnects said second end of said second segment of said first radiating element and said second end of said first feeding element.

11. The electronic device as claimed in claim 7, wherein said second radiating element has a first segment that has first and second ends, said first end of said first segment of said second radiating element being coupled to said first end of said first feeding element.

12. The electronic device as claimed in claim 11, wherein said first feeding element is disposed between said second feeding element and said second segment of said first radiating element, said second feeding element having first and second ends that are respectively proximate to and distal from said wall of said casing, said first end of said second feeding element being connected to said second end of said first segment of said second radiating element, said second feeding point being provided on said second end of said second feeding element.

13. The electronic device as claimed in claim 6, wherein said second radiating element has a first segment that extends from said first feeding element and that overlaps with said circuit board, and a second segment that extends from said first segment of said second radiating element toward said wall of said casing beyond said first edge of said circuit board, said second segment of said first radiating element being disposed between said first segment of said first radiating element and said second segment of said second radiating element.

14. The electronic device as claimed in claim 13, wherein said first feeding element is disposed between said first and second segments of said first radiating element, and has first and second ends that are respectively proximate to and distal from said first segment of said first radiating element, said second end of said first feeding element being coupled to said second end of said second segment of said first radiating element.

15. The electronic device as claimed in claim 14, wherein said first segment of said second radiating element has first and second ends that are respectively proximate to and distal from said first segment of said first radiating element, said first end of said first segment of said second radiating element being coupled to said first end of said first feeding element, said second feeding element being disposed between said second segment of said first radiating element and said second segment of said second radiating element, and having first and second ends that are respectively proximate to and distal from said wall of said casing, said second segment of said second radiating element interconnecting said second end of said first segment of said second radiating element and said first end of said second feeding element, said second feeding point being provided on said second end of said second feeding element.

16. The electronic device as claimed in claim 1, wherein said internal antenna unit further includes a second feeding element that overlaps with said circuit board and that extends from said first feeding element, and a second feeding point that is provided on said second feeding element and that is coupled to said first edge of said circuit board, said second radiating element extending from said second feeding element.

17. The electronic device as claimed in claim 1, wherein said first radiating element has first and second segments, each of which has first and second ends that are respectively proximate to and distal from said wall of said casing, and a third segment that interconnects said first ends of said first and second segments of said first radiating element, said second segment of said first radiating element being disposed between said second radiating element and said first segment of said first radiating element.

18. The electronic device as claimed in claim 17, wherein said first feeding element is disposed between said first and second segments of said first radiating element, and has first and second ends that are respectively proximate to and distal from said first segment of said first radiating element, said second end of said first feeding element being coupled to said second end of said second segment of said first radiating element, said internal antenna unit further including a second feeding element that interconnects said first end of said first feeding element and said second radiating element.

19. The electronic device as claimed in claim 1, wherein at least one of said first and second antennas is a planar inverted-F antenna.

* * * * *